US011572240B2

(12) United States Patent
Koga et al.

(10) Patent No.: US 11,572,240 B2
(45) Date of Patent: Feb. 7, 2023

(54) SHEET FEEDING APPARATUS AND IMAGE FORMING APPARATUS

(71) Applicant: CANON KABUSHIKI KAISHA, Tokyo (JP)

(72) Inventors: Hiroto Koga, Abiko (JP); Akito Sekigawa, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 33 days.

(21) Appl. No.: 16/984,419

(22) Filed: Aug. 4, 2020

(65) Prior Publication Data

US 2021/0087004 A1 Mar. 25, 2021

(30) Foreign Application Priority Data

Sep. 20, 2019 (JP) ..... JP2019-171372

(51) Int. Cl.
*B65H 3/06* (2006.01)
*B65H 3/66* (2006.01)

(52) U.S. Cl.
CPC ..... *B65H 3/0638* (2013.01); *B65H 3/66* (2013.01); *B65H 2801/06* (2013.01)

(58) Field of Classification Search
CPC ..... B65H 3/0638; B65H 2601/324; B65H 2301/418; B65H 2301/417; B65H 75/505; B65H 67/00
See application file for complete search history.

(56) References Cited

U.S. PATENT DOCUMENTS

| | | | | |
|---|---|---|---|---|
| 9,365,383 | B2 * | 6/2016 | Shimosaka | B65H 27/00 |
| 2015/0097334 | A1 * | 4/2015 | Sekiguchi | B65H 27/00 271/275 |
| 2017/0060066 | A1 * | 3/2017 | Fujita | B65H 3/66 |
| 2020/0041946 | A1 | 2/2020 | Sekigawa | |
| 2020/0247627 | A1 | 8/2020 | Sekigawa et al. | |

FOREIGN PATENT DOCUMENTS

| | | | |
|---|---|---|---|
| JP | 2004-299825 A | | 10/2004 |
| JP | 2019147677 A | * | 9/2019 |

* cited by examiner

*Primary Examiner* — Howard J Sanders
(74) *Attorney, Agent, or Firm* — Venable LLP

(57) ABSTRACT

A sheet feeding apparatus includes a sheet feeding roller including a core portion to rotatably support the feeding roller on a feeding roller shaft and a roller portion provided on an outer periphery of the core portion, with the core portion including an engaging mechanism to engage with the feeding roller shaft to restrict movement of the feeding roller in an axial direction of the feeding roller shaft. The core portion also includes a protrusion extending in the axial direction and located on an opposite side of the feeding roller shaft from the engaging mechanism. An end portion of the protrusion is positioned at downstream side of a tip portion of the feeding roller shaft in a removing direction of the feeding roller from the feeding roller shaft.

9 Claims, 11 Drawing Sheets

SHEET FEEDING APPARATUS AND IMAGE FORMING APPARATUS

BACKGROUND OF THE INVENTION

Field of the Invention

The present invention relates to a sheet feeding apparatus for feeding a sheet and an image forming apparatus with the sheet feeding apparatus.

Description of the Related Art

An image forming apparatus such as a printer having a cassette in which sheets are stacked and can be withdrawn from the main body of the apparatus is generally known. This type of image forming apparatus is equipped with rollers that convey sheets from the cassette. For example, the feeding rollers include a pickup roller that picks up the sheets out of the cassette, a feed roller that separates and feeds the picked-up sheets one by one and a retard roller. These feeding rollers should be regularly replaced, otherwise they cannot be used due to wear caused by the contact with the sheet or other rollers.

Conventionally, a cantilevered feeding roller is used and the cantilevered feeding roller is slid out of the shaft that supports the cantilevered feeding roller (see Japan Patent Application Laid-Open Publication No. 2004-299825) when removing the feeding roller from the main body of the apparatus for replacement. When replacing the feeding roller, a user releases the engagement of a claw portion formed at the side surface portion of the feeding roller from the shaft.

In recent years, the reduction of the diameter of feeding rollers is required due to the need for the downsizing of an image forming apparatus. In the vicinity of the feeding rollers mounted on the main body of the apparatus, a shaft supporting the feeding roller, a frame supporting the shaft, and a conveyance guide for guiding the conveyance of the sheet are provided, and are located in close proximity to the feeding rollers (see Japan Patent Application Laid-Open Publication No. 2004-299825). Furthermore, the position of a claw member in a rotational direction of a feeding roller is not restricted when the feeding roller is replaced.

In such a case, when a user replaces a feeding roller, it may be difficult to release the engagement of the claw member of the feeding roller because of the smaller space for pinching the claw member depending on the rotational position of the claw member of the feeding roller.

Therefore, an object of the present invention is to provide a sheet feeding apparatus that does not impair the workability of changing the feeding rollers.

SUMMARY OF THE INVENTION

To accomplish the above object, a sheet feeding apparatus according to the present invention, comprises:

a sheet feeding cassette configured to accommodate a sheet;

a feeding roller configured to feed the sheet stacked on the sheet feeding cassette;

a feeding roller shaft configured to axially support the feeding roller such that the feeding roller is rotatable around the feeding roller shaft;

a feeding guide configured to guide the sheet fed by the feeding roller; and a feeding frame configured to support the feeding roller shaft and the feeding guide, wherein the feeding roller includes a core portion configured to rotatably support the feeding roller when the feeding roller is fitted to the feeding roller shaft, and a roller portion provided on an outer periphery of the core portion, the roller portion rotating integrally with the core portion and abutting on the sheet, wherein the core portion includes an engaging portion configured to engage with the feeding shaft to restrict a movement of the feeding roller in an axial direction when the feeding roller is fitted to the feeding roller shaft, wherein the feeding roller shaft includes an engaging groove with which the engaging portion engages when the feeding roller is fitted to the feeding roller shaft, and wherein the core portion includes a protrusion extending in the axial direction at an opposing position to the engaging portion when the feeding roller is viewed from the axial direction of feeding roller shaft when the feeding roller is fitted to the feeding roller shaft.

According to the present invention, the workability of changing the feeding rollers can be improved.

Further features of the present invention will become apparent from the following description of exemplary embodiments with reference to the attached drawings.

DESCRIPTION OF THE EMBODIMENTS

Hereinafter, embodiments of the present invention will be described with reference to the drawings. In addition, in the following description, the positional relationship of up, down, left, right, and front and back is expressed based on the state of the image forming apparatus viewed from the front side (from a viewpoint of FIG. 1).

First Embodiment

[Image forming apparatus]

Figure 1:
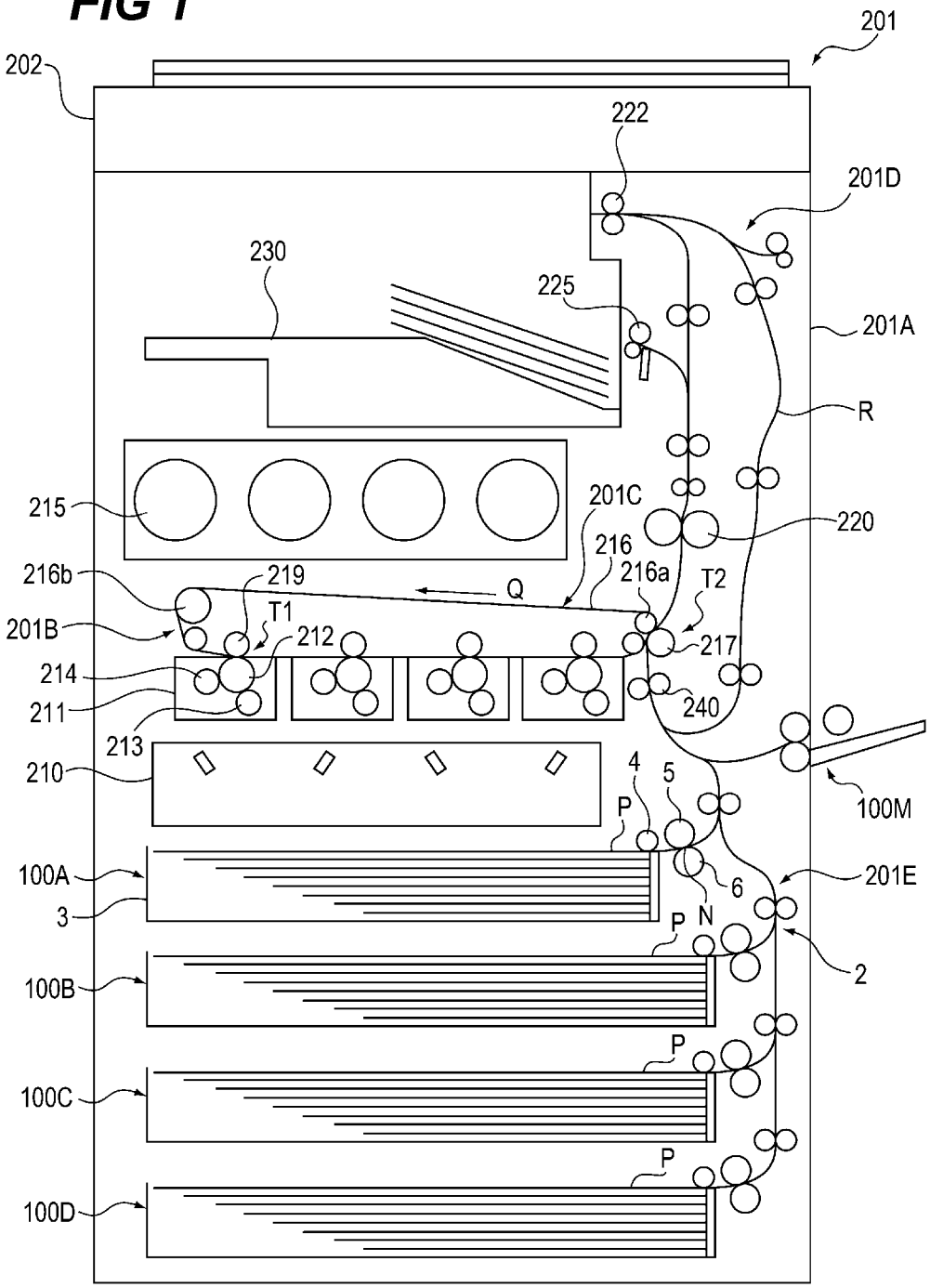
FIG. 1 is an overall schematic diagram showing a printer in the first embodiment.

The printer 201 (image forming apparatus) according to the first embodiment is an electrophotographic system full-color laser beam printer. As shown in FIG. 1, the printer 201 has the printer body 201A, which is the main body of the apparatus, and the reading apparatus 202, which is provided on the printer body 201A to read the image data of the document. The printer body 201A is provided with the image forming portion 201B for forming an image on the sheet P, the fixing portion 220 for fixing an image on the sheet P, and the like. A discharge space into which a sheet P is discharged is formed between the reading apparatus 202 and the printer body 201A, and the discharge tray 230 is provided in the discharge space where the discharged sheets P are stacked. Further, the printer body 201A is also provided with the sheet feeding portion 201E for feeding the sheet P to the image forming portion 201B. The sheet feeding portion 201E has the cassette feeding apparatuses 100A, 100B, 100C and 100D (sheet feeding apparatus) disposed at the lower part of the printer body 201A, and the manual feeding apparatus 100M disposed at the right side of the printer body 201A.

The image forming portion 201B is of a four-drum full-color type and is equipped with the laser scanner 210, the four process cartridges 211, and the intermediate transfer unit 201C. These process cartridges form yellow (Y), magenta (M), cyan (C) and black (K) toner images, respectively. Each process cartridge 211 includes the photosensitive drum 212, the charger 213, the developing device 214, the cleaner (not shown), and the like. The toner cartridges 215 containing toners of respective colors are detachably attached to the printer body 201A above the image forming portion 201B. The intermediate transfer unit 201C has the intermediate transfer belt 216 wound around the driving roller 216*a*, the tension roller 216*b*, and the like. The intermediate transfer belt 216 is disposed above the four process cartridges 211. The intermediate transfer belt 216 is disposed so as to be in contact with all the photosensitive drums 212 of the process cartridges 211, and is rotationally driven in the counterclockwise direction (direction of the arrow Q) by the drive roller 216*a* driven by a drive unit (not shown). The intermediate transfer unit 201C is equipped with the primary transfer rollers 219 that abut the inner peripheral surface of the intermediate transfer belt 216 at positions facing the photosensitive drums 212. Nip portions between the intermediate transfer belt 216 and the photosensitive drums 212 are formed as the primary transfer portions T1. Further, the image forming portion 201B is equipped with the secondary transfer roller 217 that abuts on the outer peripheral surface of the intermediate transfer belt 216 at a position facing the drive roller 216*a*. As a nip portion between the secondary transfer roller 217 and the intermediate transfer belt 216, the secondary transfer portion T2 is formed, where the toner image borne on the intermediate transfer belt 216 is transferred to the sheet P.

In each process cartridges 211 configured as described above, negatively charged toner images of respective colors are formed on the surfaces of the photosensitive drums 212 after the electrostatic latent images are formed on the surfaces of the photosensitive drums 212 by the laser scanners 210 and the toner is supplied from the developing devices 214. These toner images are multiply transferred (primary transfer) to the intermediate transfer belt 216 sequentially at respective primary transfer portions T1 by applying positive transfer bias voltages to the primary transfer rollers 219 to form a full color toner image on the intermediate transfer belt 216. In parallel with this process of forming the toner image, the sheet P fed from the sheet feeding portion 201E is conveyed to the registration roller pair 240 where the skew feeding correction for the sheet P is performed. The registration roller pair 240 conveys the sheet P to the secondary transfer portion T2 at a timing matched with the transfer timing of the full-color toner image formed on the intermediate transfer belt 216. The toner image borne on the intermediate transfer belt 216 is secondarily transferred to the sheet P at the secondary transfer portion T2 by applying a positive transfer bias voltage to the secondary transfer roller 217. The sheet P on which the toner image is transferred is heated and pressurized at the fixing portion 220 so that the color image is fixed to the sheet P. The sheet P to which the image has been fixed is discharged onto the discharge tray 230 by the discharge roller pair 225 and stacked.

When images are formed on both sides of the sheet P, after the sheet P passes through the fixing portion 220, the sheet P is switched back by the reverse roller pair 222 that is capable of rotating in forward and reverse directions and that is provided in the reverse conveying portion 201D. The sheet P is then conveyed again to the image forming portion 201B via the re-conveyance passage R, where the image is formed on the back surface of the sheet.

[Cassette feeding apparatus]

Figure 2:
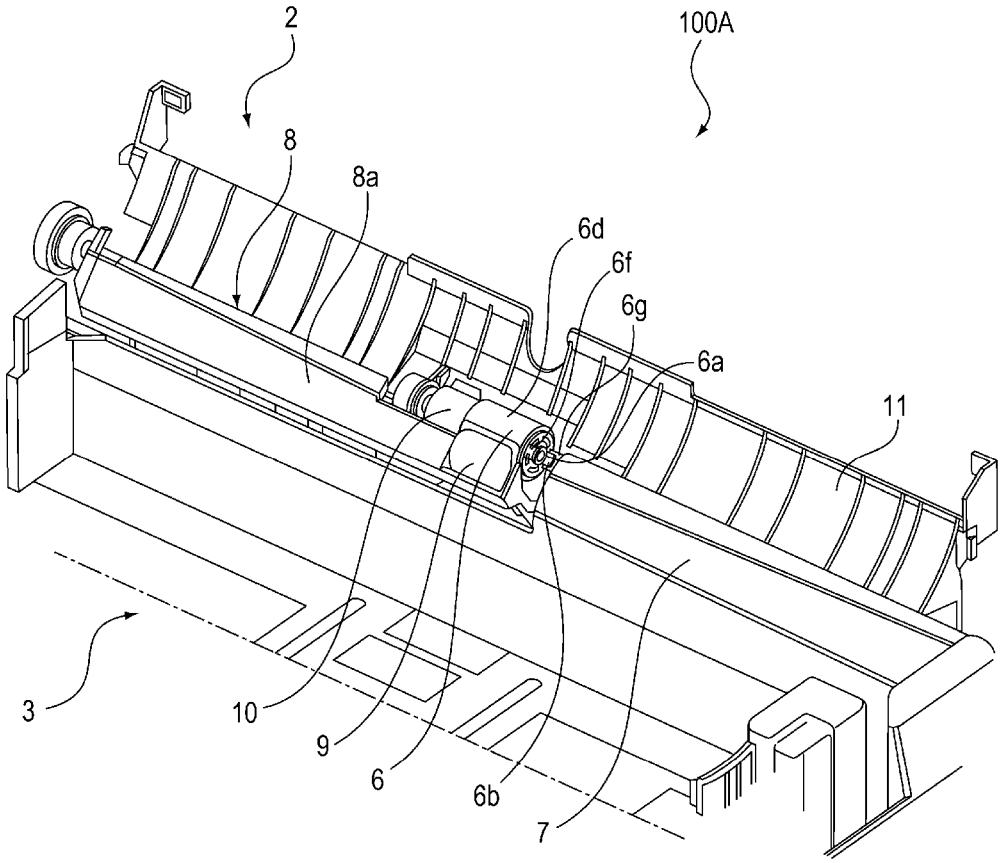
FIG. 2 is a perspective view showing a cassette feeding apparatus.

The cassette feeding apparatuses 100A, 100B, 100C and 100D as sheet feeding apparatuses will be described below. These cassette feeding apparatuses 100A, 100B, 100C, 100D have the same configuration, only the uppermost cassette feeding apparatus 100A will be described, and description of the other cassette feeding apparatuses 100B, 100C, 100D will be omitted. As shown in FIGS. 1 and 2, the cassette feeding apparatus 100A includes the feeding unit 2 provided in the printer body 201A and the cassette 3 that is a sheet feeding cassette that accommodates the sheet P and can be pulled out from and mounted to the printer body 201A.

The feeding unit 2 has feeding rollers for feeding the sheet. The feeding rollers include the pickup roller 4, the feed roller 5, and the retard roller 6, which will be described later. The feeding unit 2 has the pickup roller 4 that picks up a sheet stacked on the cassette 3, and the feed roller 5 that feeds the sheet picked up by the pickup roller 4. Further, the feeding unit 2 includes the retard roller 6, the conveyance guide 8, the downstream conveyance guide 11, and the separating mechanism 30 (see FIG. 4). The retard roller 6 forms the separation nip N together with the feed roller 5, and separates the sheets one by one together with the feed roller 5. The conveyance guide 8 is a feeding guide for guiding the sheet fed by the feeding rollers to the separation nip N.

The roller guide 9 made of a thin plate material such as a stainless-steel plate or a resin sheet is supported by the conveyance guide 8 within the width of the retard roller 6. The roller guide 9 is arranged close to the separation nip N. The sheet P picked up by the pickup roller 4 is guided by the roller guide 9 and the downstream conveyance guide 11 at the upstream and downstream sides of the separation nip N at least within the width of the retard roller 6. Further, the feeding unit 2 has the upper conveyance guide 16 that faces the cassette guide 7 and the downstream conveyance guide 11. The upper conveyance guide 16 is slidably supported by the frame 2A (see FIGS. 6 and 8) of the feeding unit 2. The roller guide 9, the downstream conveyance guide 11, and the upper conveyance guide 16 are supported by the feeding unit 2, so that the relative position between the components can be accurately determined. Accordingly, even if the retard roller 6 having a small diameter is used, the leading edge of the sheet P can be reliably guided to the separation nip N, so that the sheet can be stably conveyed. Further, the cassette guide 7 is formed on the cassette 3 for guiding at the downstream side of the retard roller 6 in the drawing direction of the cassette 3 the sheet to the separation nip N (see FIG. 1) at the downstream side of the retard roller 6 in the drawing direction of the cassette 3. The cassette guide 7, the roller guide 9, and the conveyance guide 8 are arranged side by side in the width direction (drawing direction) orthogonal to the sheet feeding direction with the cassette 3 mounted in the printer body 201A. This allows sheets of various sizes to be reliably conveyed to the separation nip N.

[Retard roller]

Figure 3:
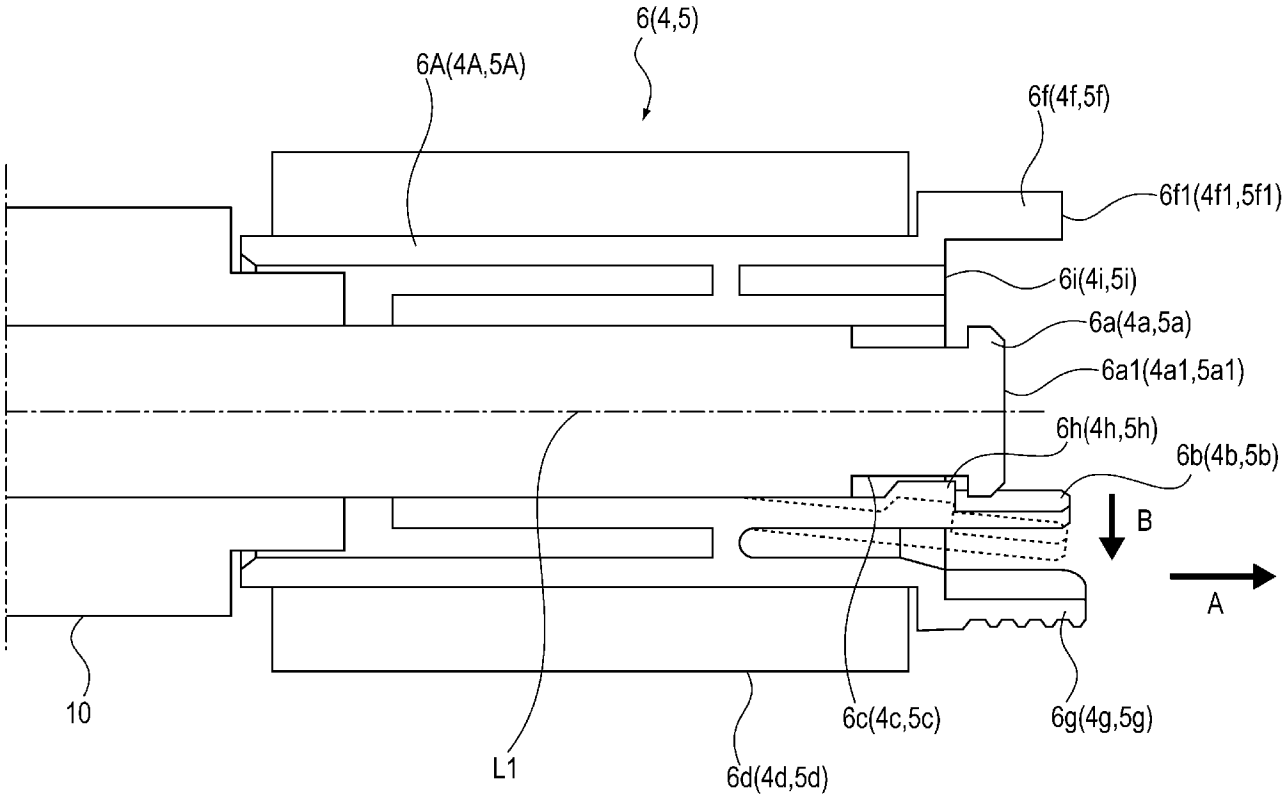
FIG. 3 is a side sectional view showing a retard roller.

As shown in FIGS. 2 and 3, the retard roller 6 is rotatably supported by the support shaft 6*a* (feeding roller shaft) driven by a motor (not shown). One end of the support shaft 6*a* is supported by the frame 2A that is the feeding frame of the feeding unit 2 and the other end of the support shaft 6*a* supports the retard roller 6. The torque limiter 10 is interposed between the support shaft 6*a* and the retard roller 6 and the support shaft 6*a* is driven in the direction opposite to the direction in which the sheet P is conveyed. When there exists no sheet P in the separation nip N or when one sheet P has entered the separation nip N, the torque limiter 10 idles, and the retard roller 6 rotates following the feed roller 5 to convey the sheet P in a sheet feeding direction orthogonal to the drawing direction. When two or more sheets P have entered the separation nip N, the retard roller 6 rotates in the direction opposite to the sheet conveying direction due to the small friction between the plurality of sheets P to separate the sheets P that are multi-fed one by one. The support shaft 6*a* has the engaging groove 6*c* that engages with the engaging portion 6*h* described later when the retard roller 6 is inserted. As shown in FIG. 3, the engaging groove 6*c* is formed on the peripheral surface of one end portion of the support shaft 6*a*. The retard roller 6 is made of resin or the like, and includes the core portion 6A with which the retard roller 6 is rotatably supported when the retard roller 6 is fitted to the support shaft 6*a*. The retarded roller 6 includes as a roller portion the periphery portion 6*d* that is provided on the outer periphery of the core portion 6A and is made from rubber or the like. The periphery portion 6*d* rotates integrally with the core portion 6A and abuts on the sheet P. The core portion 6A has the engaging portion 6*h* that engages with the support shaft 6*a* in order to restrict the axial movement of the retard roller 6 when the retard roller 6 is fitted to the support shaft 6*a*. The core portion 6A has the engagement releasing portion 6*b* and the grip portion 6*g*. The engagement releasing portion 6*b* is extended from the engaging portion 6*h* provided inside the core portion 6A so as to protrude in the axial direction from the end surface 6*i* at the other end of the retard roller 6. That is, the engagement releasing portion 6*b* is formed with the engaging portion 6*h*. When the engagement releasing portion 6*b* is elastically deformed by a user, the engaging portion 6*h* is engaged with or disengaged from the engaging groove 6*c* of the support shaft 6*a*. Therefore, to remove the retard roller 6 from the support shaft 6*a* in the arrow A direction, a user can release the engagement of the engaging portion 6*h* from the engaging groove 6*c* of the support shaft 6*a* by, for example, elastically deforming the engagement releasing portion 6*b* in the arrow B direction with one finger while placing another finger on the grip portion 6*g*. Further, the core portion 6A has the rib 6*f* which is a protrusion for operating the retard roller 6. The rib 6*f* is provided on the side opposite to the engagement releasing portion 6*b* via the support shaft 6*a*. The rib 6*f* which is the protrusion will be described later.

The pickup roller 4 and the feed roller 5 are also the feeding rollers and configured to be removable like the retard rollers 6. The configurations for removing the pickup roller 4 and the feed roller 5 are the same as those for the retard roller 6 respectively. Therefore, reference numerals are added to the members having equivalent functions in FIG. 3 and the description for the configurations is omitted.

[Separating mechanism]

Figure 4:
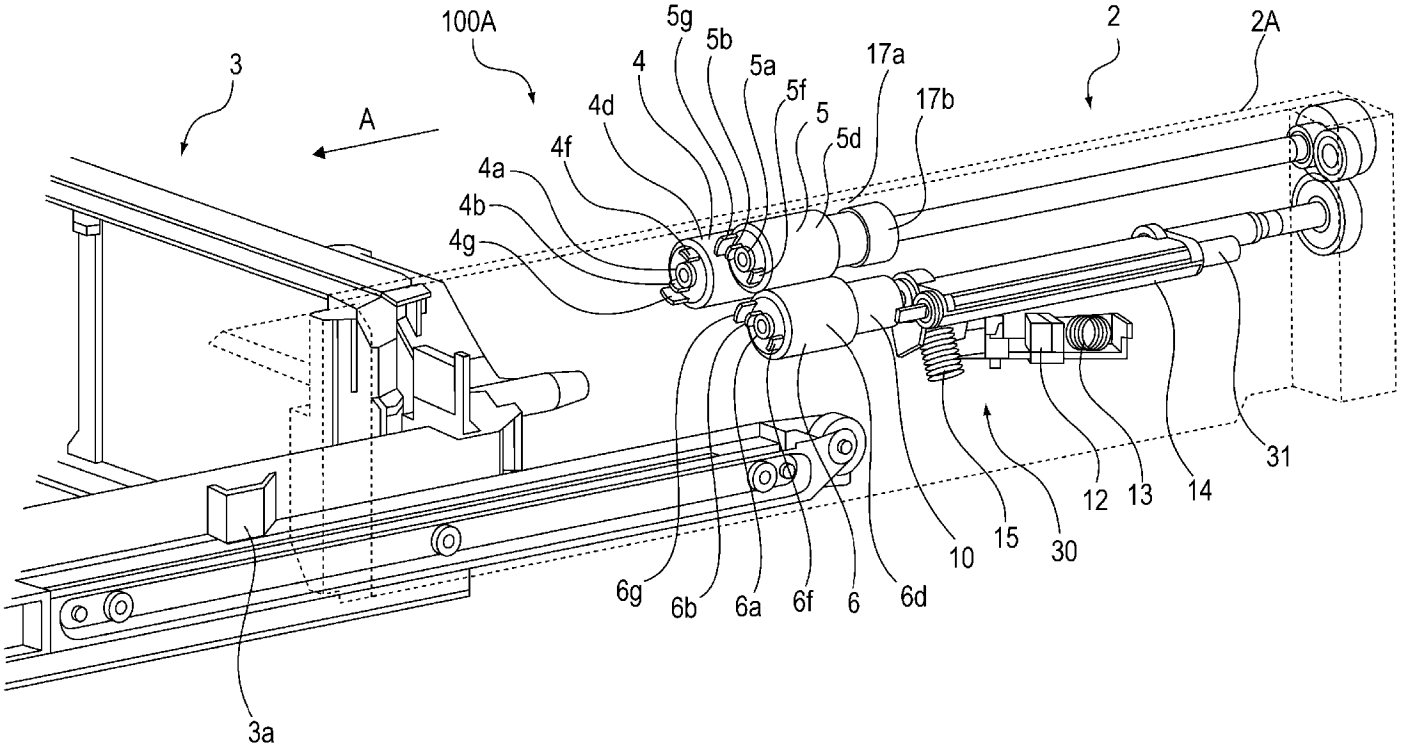
FIG. 4 is a perspective view showing a feeding unit and a separating mechanism.

As shown in FIG. 4, the separating mechanism 30 has the rotary shaft 31 rotatably supported by the feeding unit 2, and the rock holder 14 fixed to the rotary shaft 31 and pivotally supporting the support shaft 6*a* about the rotary shaft 31. The rock holder 14 is urged by the nip pressuring spring 15 (urging portion) in the direction in which the retard roller 6 is brought into contact with the feed roller 5. The separating mechanism 30 has the pressure releasing lever 12 configured to be movable. The pressure releasing spring 13 is provided between the frame 2A of the feeding unit 2 and the pressure releasing lever 12. The urging force of the pressure releasing spring 13 is set to be larger than that of the nip pressuring spring 15. On the other hand, on the side surface of the cassette 3, the protrusion 3*a* is formed that abuts on the pressure releasing lever 12 when the cassette 3 is mounted on the printer main body 201A. That is, when the cassette 3 is mounted on the printer main body 201A, the protrusion 3*a* abuts on the pressure releasing lever 12, and the movement of the pressure releasing lever 12 is restricted. In this state, the pressure releasing lever 12 does not interfere with the rock holder 14, and the rock holder 14 is rotated upward by the nip pressuring spring 15. As a result, the retard roller 6 abuts on the feed roller 5 with a predetermined nip pressure. When the cassette 3 is removed from the printer body 201A, the protrusion 3*a* formed on the cassette 3 is disengaged from the pressure releasing lever 12, and the pressure releasing lever 12 is moved by the pressure releasing spring 13. Then, the rock holder 14 abuts on the pressure releasing lever 12 and moves downward by the urging force of the pressure releasing spring 13 against the urging force of the nip pressuring spring 15. As a result, the retard roller 6 is separated from the feed roller 5, and a user can easily exchange the feed roller 5 and the retard roller 6 without receiving the resistance due to the nip pressure acting between the feed roller 5 and the retard roller 6.

[Conveyance guide]

Figure 6:
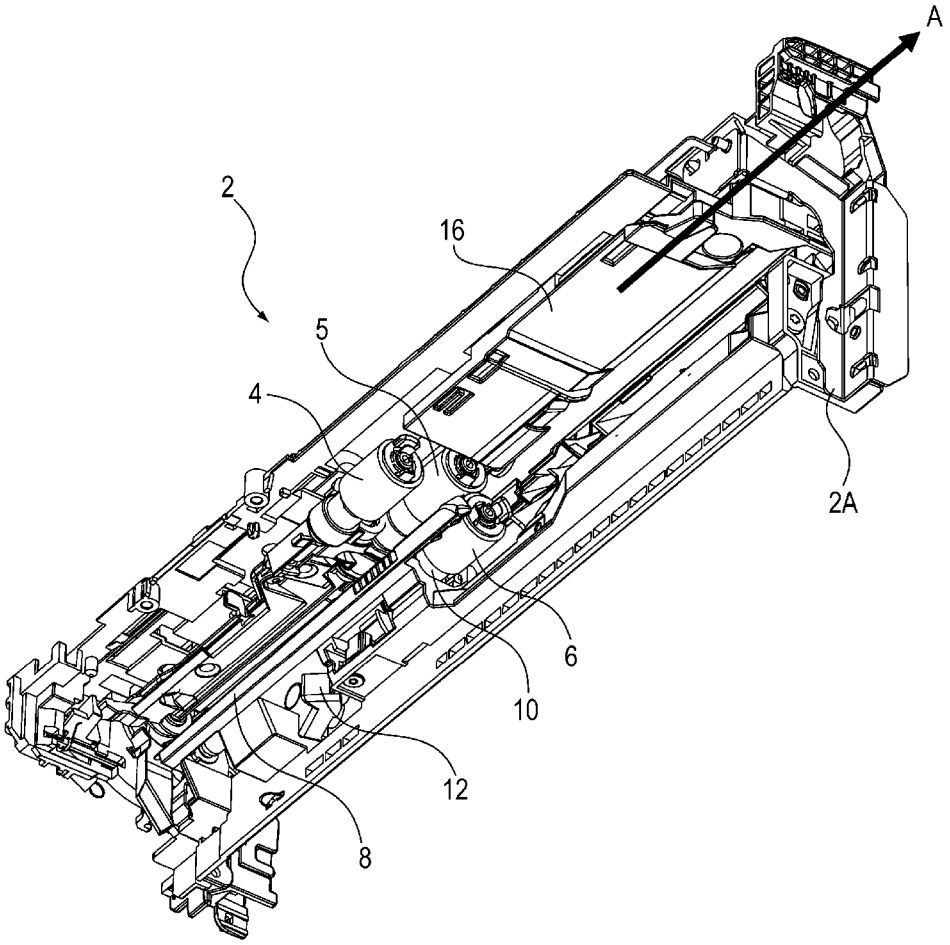
FIG. 6 is a perspective view showing the configuration of a feeding unit.
Figure 7:
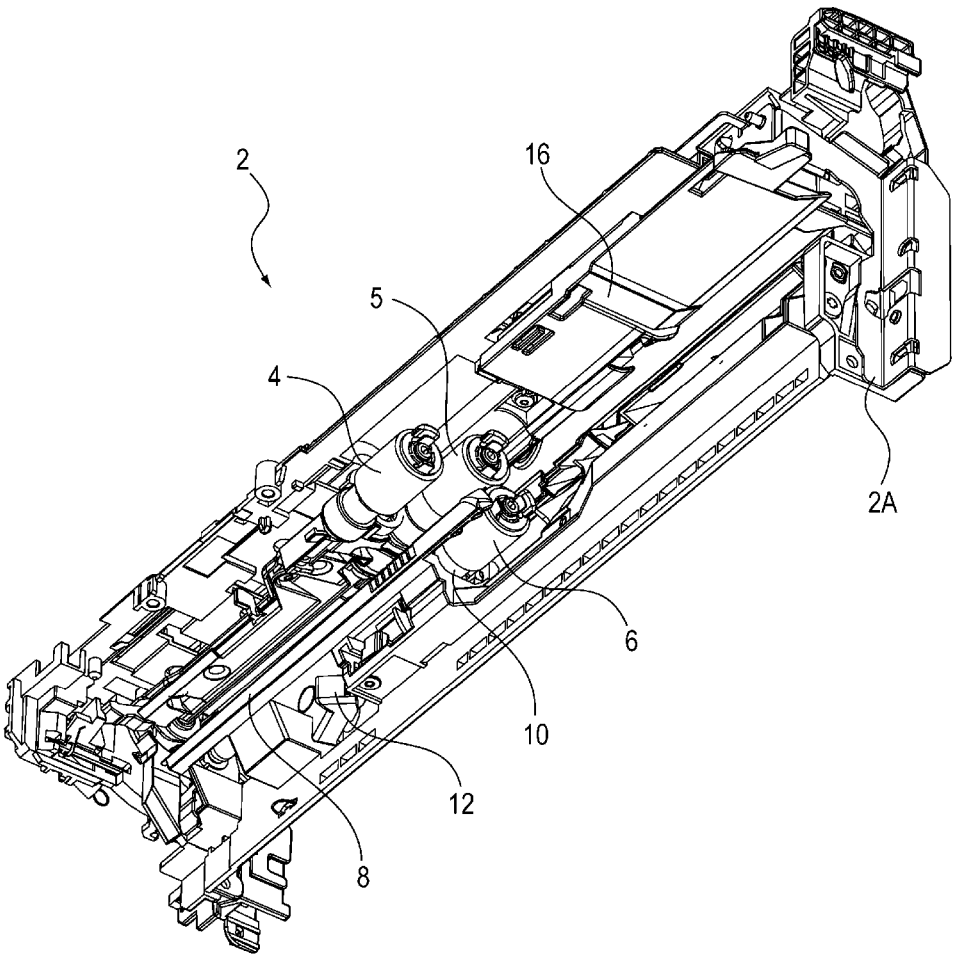
FIG. 7 is a perspective view showing the configuration of a feeding unit.

Next, the configuration of the conveyance guide 8 will be described in detail with reference to FIGS. 2, 6 and 7. The conveyance guide 8 is provided integrally with the frame 2A of the feeding unit 2, and is formed in a substantial arc shape so as to cover the retard roller 6. The guide surface 8*a* for guiding the sheet to the separation nip N is formed on the upper surface of the conveyance guide 8.

[Removal of roller]

Figure 5:
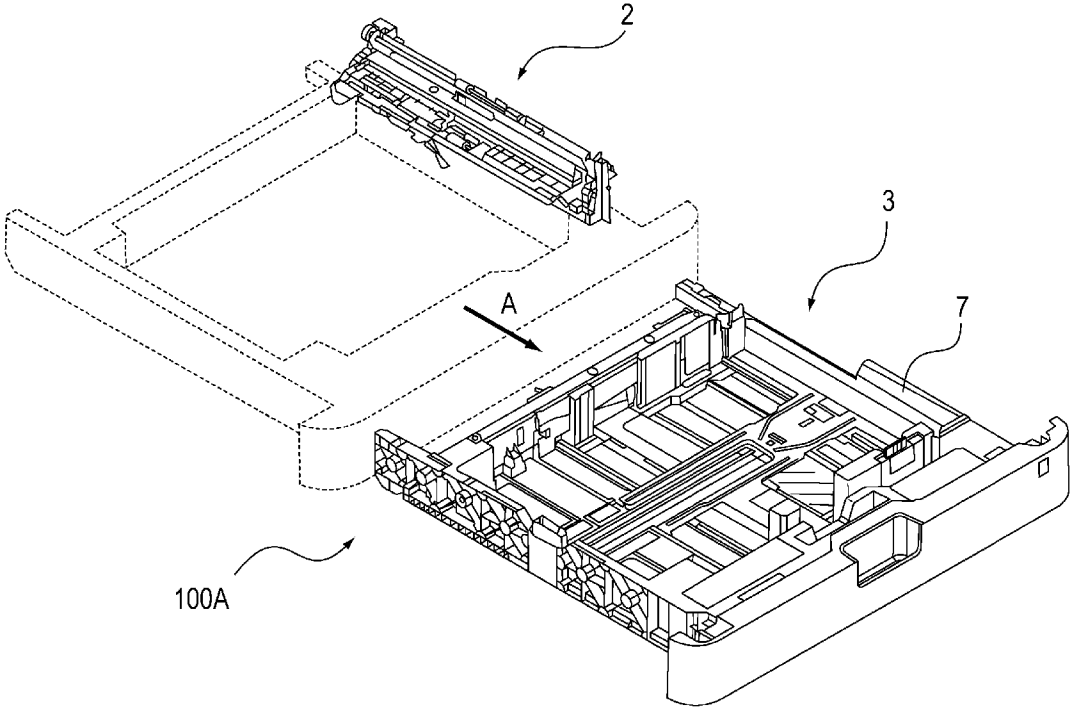
FIG. 5 is a perspective view showing a state in which the cassette is removed.

Next, the procedure for removing the pickup roller 4, the feed roller 5, and the retard roller 6, which are feeding rollers in the case where they are exchanged and maintained will be described. First, as shown in FIG. 5, a user removes the cassette 3 from the printer body 201A (see FIG. 1) in the forward direction (arrow A direction). As a result, the cassette guide 7 covering the front side of the retard roller 6 is removed together with the cassette 3 so that the internal space of the apparatus from which the cassette 3 has been removed can be used as an operating space for exchanging each roller. Then, when the cassette 3 is removed, the protrusion 3*a* and the pressure releasing lever 12 are disengaged as described above, and the retard roller 6 is separated from the feed roller 5 by the separating mechanism 30. Next, as shown in FIG. 6, a user slides the upper conveyance guide 16 covering the space in front of the rollers in the direction of arrow A, which is the drawing direction of the cassette 3, so that a space for removing the pickup roller 4 and the feed roller 5 is secured on the front side of the roller 5 as shown in FIG. 7. Then, to remove the pickup roller 4, the feed roller 5, and the retard roller 6 in the direction of arrow A, a user disengages the engaging portions 4*h*, 5*h* and 6*h* from the engaging grooves 4*c*, 5*c* and 6*c* of the support shafts 4*a*, 5*a* and 6*a* of the respective rollers by pinching the engagement releasing portions 4*b*, 5*b* and 6*b* of the respective rollers with fingers and elastically deforming them.

Figure 8:
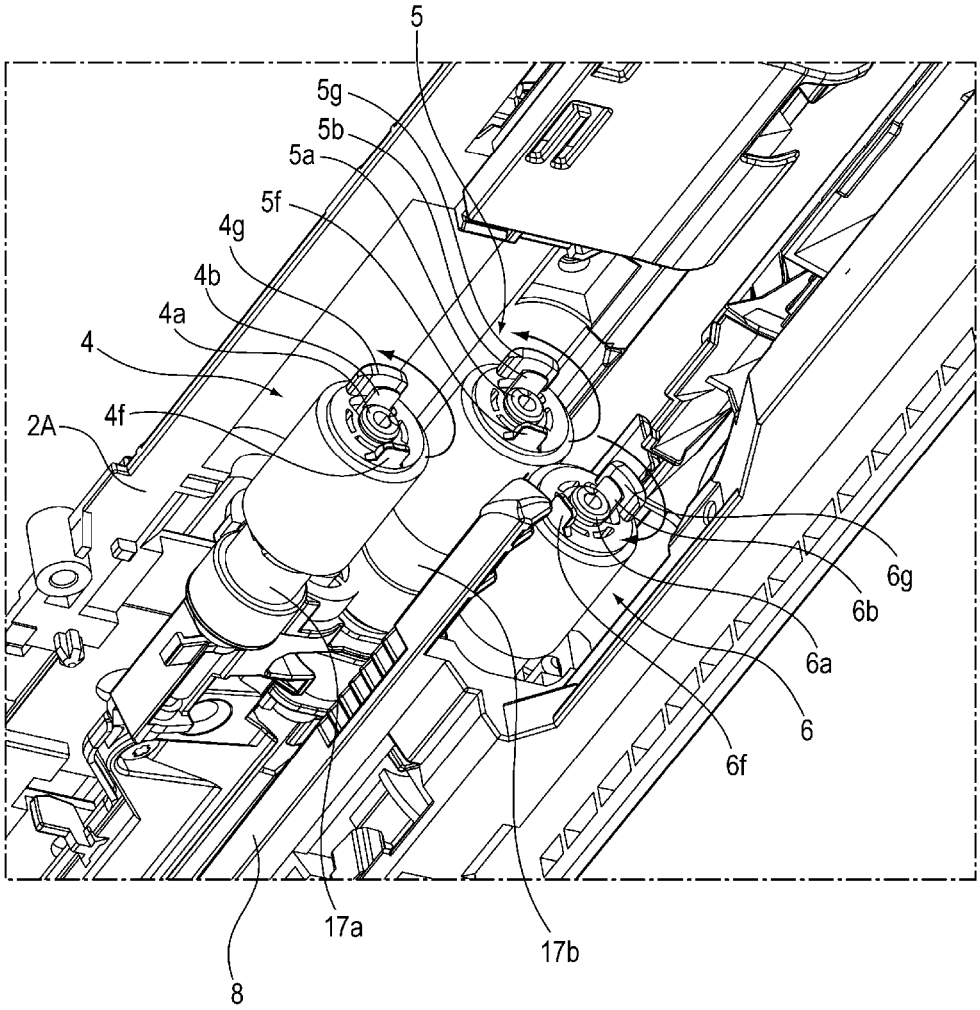
FIG. 8 is a perspective view showing how the respective rollers are replaced.

Due to the limited space around the feeding rollers in the case where the pickup roller 4, the feed roller 5, and the retard roller 6, which are the feeding rollers, are removed, the replacement work may be difficult. This will be described in detail with reference to FIG. 8. As described above, when removing the feeding rollers, it is necessary for a user to pinch the engagement releasing portions of respective rollers with their finger and to elastically deform the engagement releasing portions in order to release the engagement of the engaging portions. However, it may be difficult to pinch the engagement releasing portions depending on the phases of respective rollers during replacement. As shown in FIG. 8, when the engagement releasing portions 4*b* and 5*b* of the pickup roller 4 and the feed roller 5 are located above the support shafts 4*a* and 5*a*, the engagement releasing portions 4*b* and 5*b* are placed close to the frame 2A of the feeding unit so that it becomes difficult for a user to pinch the engagement releasing portions 4*b* and 5*b* with fingers. Similarly, when the engagement releasing portion 6*b* of the retard roller 6 is placed at the right side, the engagement releasing portion 6*b* is placed close to the frame 2A and the conveyance guide 8 so that it becomes difficult for a user to pinch the engagement releasing portion 6*b* with fingers.

Therefore, in the present embodiment, as described above, the ribs 4*f*, 5*f* and 6*f*, which are protrusions for a user to rotate the feeding rollers are provided on the core portions of respective feeding rollers (see FIG. 3). The ribs 4*f*, 5*f* and 6*f* are placed on the opposite positions to the engagement releasing portions 4*b*, 5*b* and 6*b* via the shafts 4*a*, 5*a* and 6*a*, which are the feeding roller shafts. The ribs 4*f*, 5*f* and 6*f* are respectively protruded in the axial direction from the end surfaces 4*i*, 5*i* and 6*i* of the core portions 4A, 5A and 6A (the end surfaces of the other ends in the axial directions of the feeding rollers) further than the tips of the support shafts. The ribs 4*f*, 5*f* and 6*f* are protrusions that extend in the axial direction at positions opposite to the engaging portions 4*h*, 5*h* and 6*h*, when the rollers 4, 5 and 6 are viewed from the axial direction of the shafts 4*a*, 5*a* and 6*a* with the rollers 4, 5 and 6 fitted to shafts 4*a*, 5*a* and 6*a* respectively.

Next, the retard roller 6 is exemplified as the feeding roller and a description will be made with FIG. 3 to the positional relationship between the end portion of the rib 6*f* of the retard roller 6 and the end portion of the support shaft 6*a* in the direction in which the retard roller 6 is removed.

The retard roller 6, which is a feeding roller, is mounted on the support shaft 6*a* of the retard roller 6 such that the retard roller 6 can be detached from the support shaft 6*a* in the direction of arrow A shown in FIG. 3. The direction in which the retard roller 6 is removed is the same as the direction (the direction of arrow A shown in FIG. 5) in which the cassette 3 is drawn out from the printer body 201A (see FIG. 1). Described next will be the positional relationship between the end portion of the rib 6*f* of the retard roller 6 and the tip portion of the support shaft 6*a* in the removal direction when the engaging portion 6*h* of the retard roller 6 is engaged with the engaging groove 6*c* of the support shaft 6*a*. The end portion 6*f*1 of the rib 6*f* of the retard roller 6 in the removing direction (arrow A direction) of the retard roller 6 is extended to the position at the downstream side of the end surface (tip portion) 6*a*1 of the other end side of the support shaft 6*a* in the removing direction (arrow A direction). That is, the downstream end portion 6*f*1 of the rib 6*f* of the retard roller 6 in the removing direction sticks out to the downstream side in the direction of arrow A further than the end surface (tip portion) 6*a*1 at the other end side of the support shaft 6*a*. As a result, the ribs 6*f* of the retard roller 6 can be easily accessed, and the replaceability of the rollers is improved. The pickup roller 4 and the feed roller 5 as feeding rollers are also configured to be detachable similarly to the retard roller 6 as a feeding roller. Therefore, with the above configuration, the ribs of the feeding rollers of the feeding unit 2 can be easily accessed, and the replaceability of the feeding rollers of the feeding unit 2 is improved.

Figure 9:
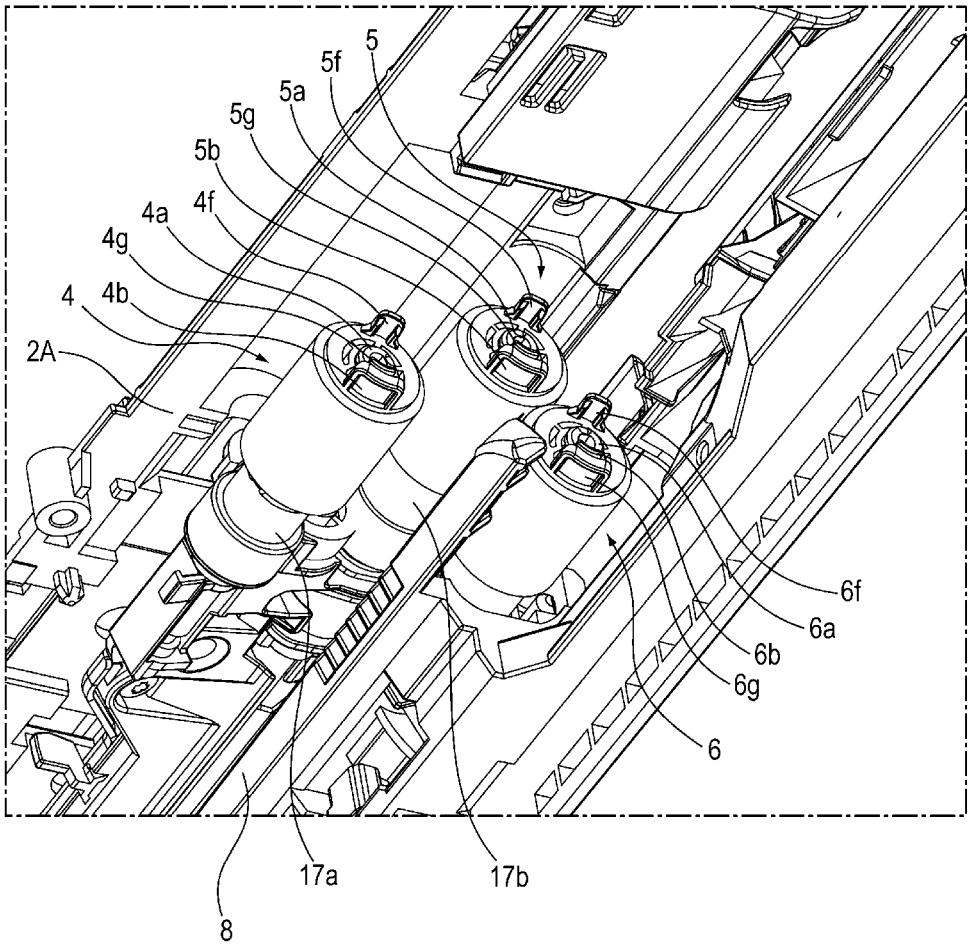
FIG. 9 is a perspective view showing how the respective rollers are replaced.

For example, as shown in FIG. 8, during the replacement of the retard roller 6, when the engagement releasing portion 6*b* of the retard roller 6 is placed at the right side in this phase, the frame 2A of the feeding unit is close to the engagement releasing portion 6*b*. Therefore, it is difficult for a user to pinch the engagement releasing portion 6*b* with fingers. Even in such a case, according to the present embodiment, a user can easily pinch the rib 6*f* which is located at a position (position opposite to that of the engagement releasing portion 6*b*) where it is easier to pinch with fingertips than at the position of the engagement releasing part 6*b*. As a result, a user can easily move the engagement releasing portion 6*b* of the retard roller 6 to a free space where it is easier to pinch the engagement releasing portion 6*b* of the retard roller 6 by pinching the rib 6*f* with fingertips and rotating the retard roller 6 in the direction of the arrow as shown in FIG. 9 in order to easily replace the retard roller 6. The same effect can be obtained for the pickup rollers 4 and feed rollers 5.

Figure 10:
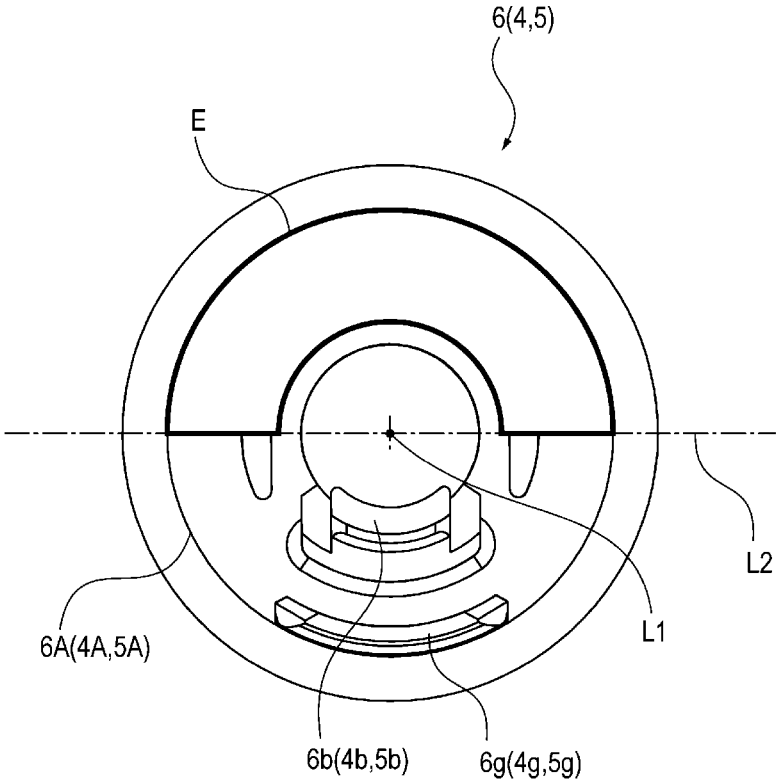
FIG. 10 is a front view showing a feeding roller according to the first embodiment.

FIG. 10 is a view of the rib 6*f* (4*f*, 5*f*), which is a protrusion, as viewed from the axial direction of the feeding roller shaft. As shown in FIG. 10, it is sufficient that the rib 6*f* (4*f*, 5*f*) is provided within the region of 180° (the rib arrangement region E) on the opposing side to the side where the engagement releasing portion 6*b* (4*b*, 5*b*) (engaging portion 6*h* (4*h*, 5*h*) (see FIG. 3) is provided via the straight line L2 passing through the rotation center L1 of the feeding roller.

Further, for the operating force by a user for rotating the pickup roller 4 and the feed roller 5 by pinching the engagement releasing portions 4*b* and 5*b*, the present embodiment is configured as follows. As shown in FIG. 8, the one-way clutch 17*a* is provided between the pickup roller 4 and the support shaft 4*a*. The one-way clutch 17*b* is provided between the feed roller 5 and the support shaft 5*a*. By the effect of the one-way clutch 17*a*, the pickup roller 4 can idle in the direction of the arrow shown in FIG. 7 around the support shaft 4*a*. Namely, the pickup roller 4 rotates relatively to the support shaft 4*a*. As a result, the pickup roller 4 can be rotated with a weaker force when the engagement releasing portion 4*b* is pinched and rotated by a user. Similarly, the feed roller 5 can idle in the arrow direction shown in FIG. 7 around the support shaft 5*a* so that the feed roller 5 can be rotated with a weaker force when the engagement releasing portion 5*b* is pinched and rotated in the arrow direction by a user. On the other hand, the retarded roller 6 is attached to the support shaft 6*a* via the torque limiter 10. Although, the retard roller 6 receives the rotational force of the torque limiter 10 when the engagement releasing portion 6*b* is pinched and the retard roller 6 is rotated in the arrow direction shown in FIG. 7 by a user, the retard roller 6 can be rotated in the arrow direction with a relatively weak force.

When replacing the feeding rollers, a user fits the rollers to be attached to the support shafts of the respective rollers and push the rollers from the front to the back of the apparatus. This attaching operation will be described next, taking the retard roller 6 as an example. The retard roller 6 should be pushed until the engaging portion 6*h* of the retarded roller 6 is engaged with the engaging groove 6*c* of the support shaft 6*a*. However, when the end surface 6*i* of the core portion 6A is pushed by a user, the tip of the support shaft 6*a* sticks out in the front direction from the end surface 6*i* of the core portion 6A. As a result, the end surface 6*i* of the core portion 6A cannot be pushed into the engagement groove 6*c* of the support shaft 6*a* until the installation is completed, which may cause an incomplete engagement of the engaging portion 6*h* of the retard roller 6 with the engaging groove 6*c* of the support shaft 6*a*. Particularly, when a roller is used, which has a small diameter aiming at space-saving, the above-mentioned engagement failure is likely to occur. If the feeding roller is improperly assembled as described above, the roller may come off during operation of the apparatus and a jam may occur. Therefore, in the present embodiment, as described above, the ribs 4*f*, 5*f* and 6*f* which are the protrusions are provided so as to protrude further in the axial direction from the end surfaces 4*i*, 5*i* and 6*i* of the core portions 4A, 5A and 6A than the tips of the support shafts. In addition, the engagement releasing portion 6*b* and the grip portion 6*g* of the core portion 6A are also provided so as to protrude further in the axial direction from the end surface 6*i* of the core portion 6A than the tip of the support shaft 6*a*. Therefore, when mounting the retard roller 6, a user can push the retard roller 6 using any of the tip of the rib 6*f*, the tip of the engagement releasing portion 6*b* and the tip of the grip portion 6*g*. This ensures the completion of the engagement of the engaging portion 6*h* of the retard roller 6 with the engaging groove 6*c* of the support shaft 6*a* without being interfered with the tip of the support shaft 6*a*.

As described above, during replacement of a feeding roller, a user can easily move the engagement releasing portion to a position where the user can easily operate the engagement releasing portion by pinching the rib (protrusion) provided on the opposing side to the engagement releasing portion provided on the core portion of a feeding roller and rotating the feeding roller. Thus, even if the diameter of the feeding roller is reduced, the workability of replacing the feeding roller can be significantly improved.

Also, a one-way clutch is provided between the feeding roller and the shaft. As a result, when the engagement releasing portion is pinched and the feeding roller is rotated, the feeding roller can idle around the shaft by the effect of the one-way clutch. Therefore, the feeding roller can be rotated with a weaker force.

Further, a rib (protrusion) provided on the opposite side to the engagement releasing portion of the core portion further protrudes in the axial direction from the end surface of the core portion than the tip of the shaft. Therefore, when mounting the feeding roller, a user can push the feeding roller by using the above-described tip of the rib. This ensures the completion of the engagement of the engaging portion of the roller with the engaging groove of the support shaft without being interfered with the tip of the support shaft.

Other Embodiments

Figure 11A:
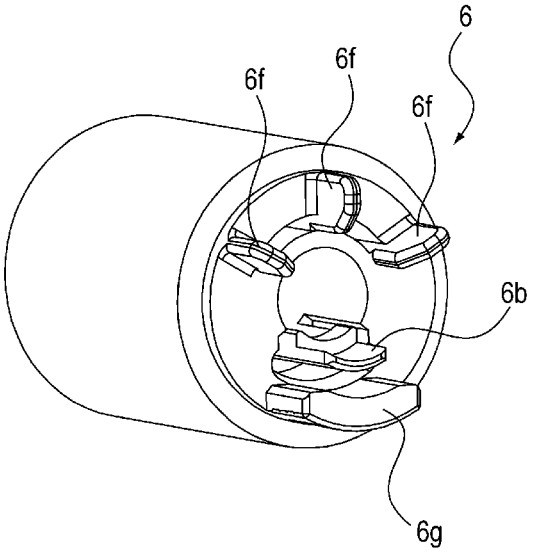
FIGS. 11A and 11B are perspective views showing the feeding roller according to the second embodiment.
Figure 11B:
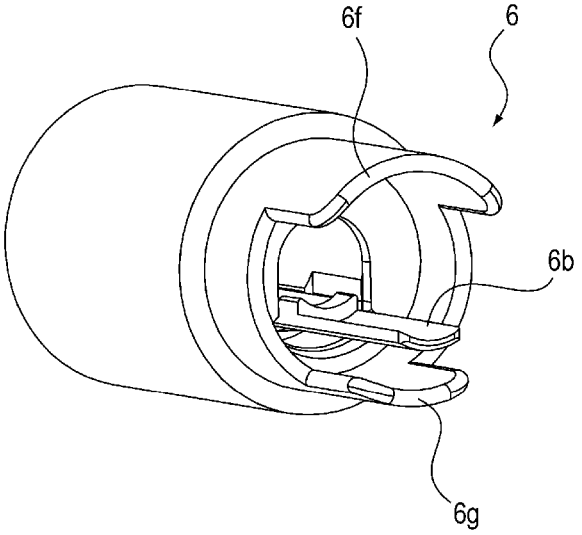

The above-mentioned embodiment has one rib as a protrusion provided in the rotational direction of the feed roller. However, the present invention is not limited to this configuration. For example, as shown in FIG. 11A, the configuration may include a plurality of ribs 6*f* in the direction of rotation of the retarded roller 6 as a feeding roller. In FIG. 11A, the configuration is illustrated in which a plurality of ribs 6*f* formed radially from the center of rotation of the retarded roller 6 toward the periphery is provided in the rotational direction of the roller. The shape of the protrusions is not limited. For example, as shown in FIG. 11B, the rib 6*f* formed in an arc-shape along the outer surface of the retard roller 6 can be provided as the protrusion. In FIG. 11B, the configuration with one continuous arc-shaped rib 6*f* is shown as an example. The present invention is not limited to this configuration. A plurality of arc-shaped ribs can be provided in the rotational direction of the roller. Even with this configuration, the same effect as that of the aforementioned embodiment can be obtained.

In any of the above configurations, during the replacement of the retarded roller 6, even if the engagement releasing portion 6*b* or the grip portion 6*g* is in a phase where it is difficult to pinch the engagement releasing portion 6*b* or the grip portion 6*g* with fingers, a user can easily move the engagement releasing portion 6*b* to a position where the user can easily operate it by pinching the above-described rib 6*f* and rotating the retard roller 6. As a result, the workability of replacing the retard roller 6 can be improved. Further, when mounting the retard roller 6, the roller can be pushed in until the mounting is completed by using the rib 6*f* described above. Therefore, the engaging portion of the core portion of the roller can be reliably engaged with the engaging groove of the support shaft. As a result, it is possible to provide a sheet feeding apparatus without mounting failures.

Further, in the above-described embodiment, the printer including the reading apparatus is exemplified as the image forming apparatus, but the present invention is not limited to this configuration. For example, the image forming apparatus can be a single-purpose printer or any other image forming apparatus. The above described image forming apparatus with an intermediate transfer member, transfers toner images of respective colors to the intermediate transfer member in a sequentially superimposed manner, and transfers the toner images borne on the intermediate transfer member to a sheet at one time. However, the present invention is not limited to this configuration. An image forming apparatus can be adopted, which has a sheet supporting member and transfers toner images of respective colors onto the sheet supported on the sheet supporting member in a sequentially superimposed manner. The same effect can be obtained by applying the present invention to the sheet feeding apparatus used in these image forming apparatuses.

Further, in the above-described embodiment, the sheet feeding apparatus integrally provided in the image forming apparatus is exemplified. However, the present invention is not limited to this configuration. A sheet feeding device can be used, which is attachable to and detachable from the image forming apparatus. The same effect can be obtained by applying the present invention to these sheet feeding apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2019-171372, filed Sep. 20, 2019, which is hereby incorporated by reference herein in its entirety.

What is claimed is:

1. A sheet feeding apparatus, comprising:

a sheet feeding cassette configured to accommodate a sheet;

a feeding roller configured to feed the sheet stacked on the sheet feeding cassette;

a feeding roller shaft configured to support the feeding roller such that the feeding roller is rotatable around the feeding roller shaft;

a feeding guide configured to guide the sheet fed by the feeding roller; and a feeding frame configured to support the feeding roller shaft and the feeding guide, wherein the feeding roller includes a core portion configured to rotatably support the feeding roller for the feeding roller shaft, and a roller portion provided on an outer periphery of the core portion, the roller portion rotating integrally with the core portion and abutting on the sheet, wherein the core portion includes an engaging mechanism configured to engage with the feeding roller shaft to restrict a movement of the feeding roller in an axial direction of the feeding roller shaft in a state the feeding roller is fitted to the feeding roller shaft, wherein the feeding roller shaft includes an engaging groove with which the engaging mechanism engages in a state the feeding roller is fitted to the feeding roller shaft, wherein the core portion includes a protrusion extending in the axial direction and located at an opposite side of the feeding roller shaft from the engaging mechanism when the feeding roller is viewed from the axial direction, and wherein in a state the engaging mechanism of the core portion engages in the engaging groove of the feeding roller shaft, an end portion of the protrusion is positioned at a downstream side of a tip portion of the feeding roller shaft in a removing direction of the feeding roller from the feeding roller shaft.

2. The sheet feeding apparatus according to claim 1, wherein the protrusion is formed in an arc-like shape along an outer periphery of the feeding roller.

3. The sheet feeding apparatus according to claim 1, wherein the protrusion is formed radially from a rotation center of the feeding roller toward a peripheral portion.

4. The sheet feeding apparatus according to claim 3, wherein the protrusion is provided in plurality in a rotational direction of the feeding roller.

5. The sheet feeding apparatus according to claim 1, wherein the protrusion is provided within the region of 180° on an opposing side to the side where the engaging mechanism is provided, via a straight line passing through a rotation center of the feeding roller when the feeding roller is viewed from the axial direction.

6. The sheet feeding apparatus according to claim 1, wherein a one-way clutch is provided between the feeding roller shaft and the feeding roller, and wherein the feeding roller rotates relatively to the feeding roller shaft.

7. The sheet feeding apparatus according to claim 1, further comprising;

a grip extending in the axial direction and located on a same side of the feeding roller shaft as the engaging mechanism for working to deform the engaging mechanism elastically.

8. An image forming apparatus, comprising:

a sheet feeding apparatus, an image forming portion configured to form an image on a sheet fed by the sheet feeding apparatus, wherein the sheet feeding apparatus includes:

a sheet feeding cassette configured to accommodate a sheet;

a feeding roller configured to feed the sheet stacked on the sheet feeding cassette;

a feeding roller shaft configured to axially support the feeding roller such that the feeding roller is rotatable around the feeding roller shaft;

a feeding guide configured to guide the sheet fed by the feeding roller; and a feeding frame configured to support the feeding roller shaft and the feeding guide, wherein the feeding roller includes a core portion configured to rotatably support the feeding roller for feeding the roller shaft, and a roller portion provided on an outer periphery of the core portion, the roller portion rotating integrally with the core portion and abutting on the sheet, wherein the core portion includes an engaging mechanism configured to engage with the feeding roller shaft to restrict a movement of the feeding roller in an axial direction of the feeding roller shaft in a state the feeding roller is fitted to the feeding roller shaft, wherein the feeding roller shaft includes an engaging groove with which the engaging mechanism engages in a state the feeding roller is fitted to the feeding roller shaft, wherein the core portion includes a protrusion extending in the axial direction and located at an opposite side of the feeding roller shaft from the engaging mechanism when the feeding roller is viewed from the axial direction, and wherein in a state the engaging mechanism of the core portion engages in the engaging groove of the feeding roller shaft, an end portion of the protrusion is positioned at a downstream side of a tip portion of the feeding roller shaft in a removing direction of the feeding roller from the feeding roller shaft.

9. The image forming apparatus according to claim 8, further comprising;

a grip extending in the axial direction and located on a same side of the feeding roller shaft as the engaging mechanism for working to deform the engaging mechanism elastically.

* * * * *